US005195573A

United States Patent [19]

Cryderman et al.

[11] Patent Number: 5,195,573

[45] Date of Patent: Mar. 23, 1993

[54] CONTINUOUS RAIL PRODUCTION

[75] Inventors: Robert L. Cryderman; John C. Winkley, both of Pueblo, Colo.

[73] Assignee: CF&I Steel Corporation, Pueblo, Colo.

[21] Appl. No.: 568,552

[22] Filed: Oct. 15, 1990

Related U.S. Application Data

[62] Division of Ser. No. 444,789, Dec. 1, 1989, Pat. No. 5,018,666.

[51] Int. Cl.[5] ..... B22D 11/06

[52] U.S. Cl. ..... 164/476; 29/527.7; 148/541

[58] Field of Search ..... 164/476, 460, 418; 148/2; 29/527.7

[56] References Cited

U.S. PATENT DOCUMENTS

| | | | |
|---|---|---|---|
| 1,213,745 | 1/1917 | Cash | 238/125 |
| 3,310,971 | 3/1967 | Motomatsu | 72/21 |
| 3,342,053 | 9/1967 | Stammbach | 72/226 |
| 3,416,222 | 12/1968 | Pearson | 29/527.7 |
| 3,544,737 | 12/1970 | Nowalk | 191/22 R |
| 3,555,862 | 1/1971 | Yoshino | 72/10 |
| 3,680,623 | 8/1972 | Tarmann | 164/476 |
| 3,999,276 | 12/1976 | Brown | 29/431 |
| 4,301,570 | 11/1981 | Engel | 16/85 |
| 4,344,310 | 8/1982 | Kozono | 72/234 |
| 4,381,658 | 5/1983 | Kugushin | 72/234 |
| 4,393,784 | 7/1983 | Theurer | 104/2 |
| 4,503,700 | 3/1985 | Kishikawa | 72/225 |
| 4,584,029 | 4/1986 | Chia | 164/476 |
| 4,820,015 | 5/1989 | Takeuchi | 385/31 |
| 4,846,254 | 7/1989 | Kimira | 164/476 |

FOREIGN PATENT DOCUMENTS

| | | | |
|---|---|---|---|
| 60-18201 | 1/1985 | Japan | 29/527.7 |
| 63-16833 | 1/1988 | Japan . | |

*Primary Examiner*—Richard K. Seidel
*Assistant Examiner*—Rex E. Pelto
*Attorney, Agent, or Firm*—Beaton & Swanson

[57] ABSTRACT

A superior unitary one quarter mile long railroad rail and system and method for manufacturing the same. The method of manufacture is characterized by the use of a continuous rolling process and the in-line controlled cooling of the rail. The long railroad rail is rolled in a single direction with a plurality of in-line rolling stations.

9 Claims, 3 Drawing Sheets

CONTINUOUS RAIL PRODUCTION

This is a divisional of copending application Ser. No. 07/444,789 filed on Dec. 1, 1989 now U.S. Pat. No. 5,018,666 dated May 28, 1991.

FIELD OF THE INVENTION

This invention relates to a superior railroad rail and method for producing the same. A continuous rolling process in-line with a controlled cooling process enables the production of rails possessing superior performance characteristics. The rails of the present invention are of a unitary construction and are in the standard one quarter mile length. In addition, the method of the present invention provides rails of superior quality in a cost efficient manner.

BACKGROUND OF THE INVENTION

Railroads maintain a vital position in the transportation of goods and, to a lesser extent, passengers The maintenance of the current rail system and the establishment of new rail lines requires a continuous source of new railroad rails.

Traditionally, rails were manufactured in sections that were about 39 feet long. This length was arrived at simply due to the length of the train cars that carried the rails to the site of installation. At the site, the rail sections were bolted together. The use of these short rail sections and the unevenness created by the bolted attachment caused several problems In the first place, the discontinuous rails made for a very rough ride. More importantly, the rough ride leads to increased rail wear and limits the maximum speed that trains can achieve on the rails. Bolting the rail sections together at the site also is a time-consuming and expensive process.

More recently, it has become standard practice to weld the rails sections together, rather than to bolt the sections together. The continuous welded rails give a substantially smoother ride and, therefore, lead to more durable rails. Along with the advent of rail welding, it became a common practice for the rail manufacturer, railroad or subcontractor to weld rail sections together into a relatively long ribbon at the manufacturing site. It is typically the current practice to have rail sections—from 39 feet to up to 100 feet or more—welded into quarter mile long ribbons. Special railroad cars are used to deliver the welded ribbons to the rail installation site. The welded ribbons are then either bolted or welded to one another at the installation site.

This practice has great advantages in both efficiency and superior rail quality when compared with the traditional bolting process. However, this method still has several disadvantages. Although the weld junctures used to join the short sections into quarter mile ribbons provide a smoother surface and last longer than the bolted attachment, the weld sites remain the weakest points on the rail since they have the discontinuity of the weld and also retain a softened segment on each side of the weld with non-desirable metallurgical properties. The welding process also requires a separate facility at which the shorter rail sections are prepared before welding, and are ground flush, straightened and inspected for integrity after welding.

There are no descriptions in the prior art or actual examples of non-welded unitary ribbons that approach the length of the welded ribbons currently in use. As mentioned above, rail sections are typically manufactured in lengths varying from 39 to 100 feet or more, and then are welded into the long ribbons.

In current practice, rail production includes the following steps: 1) bloom formation, 2) bloom reheating, 3) reverse rolling of the bloom to form a blank, 4) reverse rolling of the blank to from a rail, 5) cooling and straightening of the formed rail, 6) inspection of the rail, and 7) heat treatment of the rail to give superior wear characteristics.

Bloom formation is accomplished either by continuous casting or by ingot casting and breakdown rolling. In the typical arrangement, bloom formation is done at a discrete location from the rail rolling facility, and the bloom is allowed to cool before being rolled so that it must be reheated before being rolled. Some processes include rapid transport to final rolling so that the blooms do not cool and do not require reheating.

The bloom is heated to approximately 2250° F. and subjected to a series of "rolling" treatments. The rolling consists of passing the malleable bloom between large rollers that exert significant pressure on the metal in order to elongate and shape the incipient rail. A critical factor in rail formation, is that the end product is not symmetrical about the horizontal axis. In order to obtain the asymmetrical rail, the bloom must not only be rolled in order to achieve the proper shape, but attention must be given to the internal stresses created within the metal due to the asymmetric rolling process.

The bloom is rolled in a "pass" through a rolling station until the entire section has passed between the rollers. The direction of movement of the bloom is then reversed, and the bloom will pass back through the same roller station. Depending on the type of roller station employed, the bloom may go between the same roll groove, or a different roll groove exerting pressure on different sections of the bloom. The bloom may undergo up to 10 to 12 passes at a single rolling station before proceeding to the next rolling station. This back and forth process is commonly referred to as "reverse rolling." After proceeding past the first rolling station, the incipient rail is often referred to as a blank.

The blank will pass from rolling station to rolling station in this back and forth manner until the final rail is formed. In addition to rolling stations, the typical rail manufacturing process will include both edgers and end cutters to provide a useable rail form.

After proceeding through the final rolling station, the rails will be subjected to a controlled cooling process. The controlled cooling will often include the asymmetric application of cooled air, water or a combination of both to the rail in order to prevent gross distortion of the rail as it cools. The different portions of the asymmetric rail, which has a head, a base and web portions, will naturally tend to cool at different rates. Because of the differential rates of cooling in the different sections of the rail, if the rail is allowed to cool in a non-controlled environment significant rail bowing or arching will occur.

During the reverse-rolling processes currently used to produce rails, considerable attention is paid to the ends of the incipient rail. As the end of the blank exits a given roller station considerable energy is applied to the metal through the rollers, and it is quite common that this will lead to some end distortion. Since the blank must enter between the rapidly spinning rollers on each pass through a rolling station, if the end is sufficiently deformed it is possible that the blank will not enter the roller properly and the entire process will be halted. In as many as three places in the process, it is necessary to cut off the ends of the bloom or blank in order to obtain a properly formed end.

Due to the nature of the reverse rolling process, it is impossible to produce very long rails. In each pass through a rolling station, the rollers must be set so that a uniform cross-sectional deformation is produced throughout the entire length of the blank. If there is a temperature gradient from one end to the other in the rail, the malleability will also vary and the uniform deformation will not be achieved. Such temperature gradients are inherent in reverse rolling long products.

An advantage of the reverse rolling process is that the rail can be manufactured in a relatively small area utilizing only a few rolling stations. Of course, the numerous reverse passes of the process cause significant delays in the production, as only one blank is rolled at a rolling station at a time.

Examples of disclosures that discuss the formation of rails using reverse rolling processes are in U.S. Pat. Nos. 4,301,670 of Engel and 4,344,310 of Kozono. In U.S. Pat. Nos. 3,342,053 of Stammbach and 4,503,700 of Kishikawa, processes that are referred to as "continuous" for producing rails are described. However, neither of these patents describes a truly continuous process. In both the Stammbach and Kishikawa patents, reverse rolling occurs in at least the blank formation stage.

U.S. Pat. Nos. 3,310,971 of Motomatsu and 3,555,862 of Yoshimo both describe processes for the continuous rolling production of large cross section steel products. Neither of the patents suggest the use of their process to produce asymmetric rails.

U.S. Pat. No. 4,820,015 of Takeuchi discloses a continuous casting process for the formation of composite metal material. This continuous casting process is used in one embodiment to form a bloom that would be used for rail production. Takeuchi does not suggest that the continuous casting process be coupled with a continuous rolling process to form steel rails.

None of the above references teaches the manufacturing of rails that are unitary, non-welded and about one quarter mile long. Further, none of the above references teaches the manufacturing of rails utilizing a truly continuous rolling process. "Continuous rolling," as used herein, means a process wherein the malleable steel is successively passed through one rolling station after another without reversing, and various sections of the same incipient rail are simultaneously being rolled at more than one rolling station.

Finally, none of the above references teaches a process for the production of rails wherein different sections of a given blank are being rolled and cooled simultaneously.

SUMMARY OF THE INVENTION

The present invention relates to a superior rail and a manufacturing system and method for obtaining the same. The rail of the present invention is of the same length as the currently used welded rail ribbons, but because it is made in a continuous process it is free of welds and other imperfections created in the reverse rolling and welding production of rails.

The rail of the present invention is greater than 200 feet long and preferably is about one quarter mile or about 1440 feet long. The rail is manufactured in a continuous rolling process and is free from end deviations and is free from welds.

The continuous rolling manufacturing process of the present invention is capable of producing the quarter mile long unitary rail. The process is characterized by a series of rolling stations, whereby different sections of the formative rail are simultaneously being rolled at a plurality of rolling stations. The continuous rolling process is also continuous and in-line with a controlled cooling process.

According to a preferred embodiment of the present invention, a continuous casting process is utilized in order to manufacture the bloom that is introduced into the continuous rolling process. In the most preferred embodiment, two or more continuous casting units are utilized in order to maximize the efficient use of the continuous rolling system, since the preferred speed of the malleable steel at the entrance to the continuous rolling system is faster than the speed of the production of the bloom via the continuous casting process.

The continuous rolling section of the present invention is comprised of a plurality of rolling stations. The leading end of the malleable steel passes from station to station, and the bloom is of such a length that a single formative rail is simultaneously being processed at a plurality of rolling stations. At each rolling station, the rail cross-section is progressively reduced and shaped. As the rail exits the continuous rolling system, the desired rail cross section has been achieved.

Immediately following the continuous rolling section, the rail proceeds into the controlled cooling portion of the manufacturing process. In this manner, while the lead portion of the rail is being cooled, the trailing portion is still within the continuous rolling station.

Throughout the continuous rolling process the bloom is continuously and progressively lengthened as the cross section is reduced. It is, therefore, not until the entire rail has passed through the last rolling station that the full final length of the rail has been obtained.

As the leading end of the rail exits the last rolling station, it continues to cool. This cooling, if allowed to proceed uninterrupted, would occur differentially in the asymmetrical rail section and would produce stress and deformation of the rail. To prevent this, and to optimize metallurgical properties, the rail is cooled by controlled cooling and then final cooling which is continuous and in-line with the rolling stations. Therefore, the leading end of the rail is being cooled even while the trailing end is still being rolled.

The present invention allows the velocity of the rail to be reduced considerably. Reverse rolling requires a fast-rolling rate at each rolling station because each rolling station generally must perform several passes to reduce the blank cross-section. In the present invention, the multiple passes are replaced with multiple rolling stations. Therefore, the rail velocity can be reduced while still achieving the same production rate. This velocity reduction is important, for as explained below it allows the controlled cooling operation to be performed continuously and in-line with the rolling and also enhances control and safety.

It is not until after the full length of the rail has proceeded through this final cooling and transfer section that the forward movement of the rail is halted. After cooling, the rail is moved laterally and the rail is moved axially back in the opposite direction past inspection and repair areas.

DETAILED DESCRIPTION OF THE PRESENT EMBODIMENT

A superior railroad rail and a system and method for manufacturing the same is described in more detail below. The rail of the invention is of a conventional shape except that it is substantially free of welds, is produced via a continuous rolling process, and is more than about 200 feet long. In the preferred embodiment, the rail is about one quarter mile or 1440 feet long.

The rail of the present invention is superior to rails presently in use, in that when laid on site, the number of welds for any given distance of rail is dramatically reduced. For example, railroad track using the one quarter mile long rail of the present invention would contain four welds per mile per rail. On the other hand, utilizing the ribbon rails currently available—assuming 80 foot sections are used—the same one mile stretch of rail would contain about 65 welds.

As described above, such a rail could not be produced following currently utilized processes for the production of rails. This is due to temperature gradient and other limitations in the reverse rolling process. Therefore, the one quarter mile long unitary rail of the present invention represents a novel and unique product—irrespective of the mode used to manufacture such rail.

Figure 1:
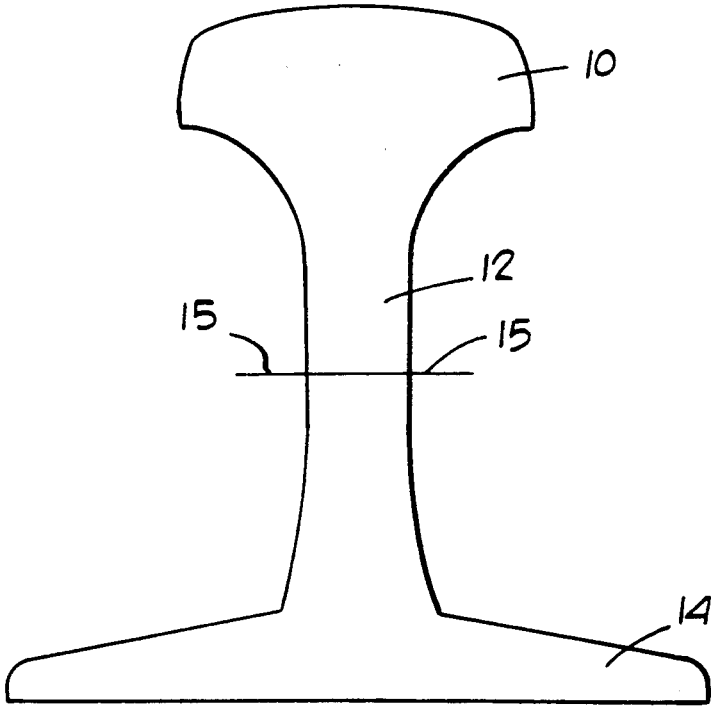
FIG. 1 is a cross-sectional view of a typical rail.

FIG. 1 shows a cross-sectional view of a typical rail. The rail is composed of head 10, web 12 and base 14 sections. When the rail is referred to as being asymmetric, what is being considered is symmetry with respect to an imaginary horizontal line 15. Although all rails have the same general cross-sectional shape, the actual dimensions of various currently manufactured and used types of rails are slightly different. Slight variations in the rail cross-section can be attained by adjusting the rolling forces in the continuous rolling stations of the present invention.

The asymmetry of the rail cross-section leads to problems in the cooling process of the rail. Typically, when the rail is formed and of the proper cross-sectional shape it still will be in excess of 1400° F. As the rail cools to room temperature, the larger mass of the head will cool more slowly than the base, and the rail will tend to bow as the cooler base shrinks more rapidly than the head portion. Unfortunately, the strain created in the cooling is not totally dissipated as the entire rail reaches room temperature, but results in internal stresses that will affect the performance characteristics of the completed rail. For this reason, it is preferred that rails be subjected to a controlled cooling wherein the head and base portions of the rail are differentially cooled.

Continuous rolling processes for the production of small cross-section steel products such as bar steel or rods are quite common. In continuous rolling processes, as contrasted to reverse rolling processes, the malleable steel is treated simultaneously at a plurality of rolling stations. The major concern in continuous rolling, is the need to provide some type of "tension buffer" between rolling stations. The rollers used to form the steel products are extremely heavy and are rotated at high rates of speed.

When being treated simultaneously at a series of roller stations, it becomes difficult to make any instantaneous adjustments in roller speed at any given station. In such a situation, even a very slight increase or decrease in rotation rate at a single station will create significant tension on the malleable steel. The tension could lead to, at the least, inferior steel products, and at the worst, a dangerous rolling operation.

For small cross-section products, the tension buffer is created by allowing the steel to bow between rolling stations. Slight variations in roller speed are compensated for by the amount of bowing. U.S. Pat. Nos. 3,310,971 of Motomatsu and 3,555,862 of Yoshimo both describe means for providing tension buffers in continuous rolling processes where the cross-sectional size of the material is too large to allow bowing or looping between rolling stations. It is within the capability of one of ordinary skill in the art to utilize available technology such as this to establish the appropriate and most desireable tension buffer for use with the present invention.

Figure 2:
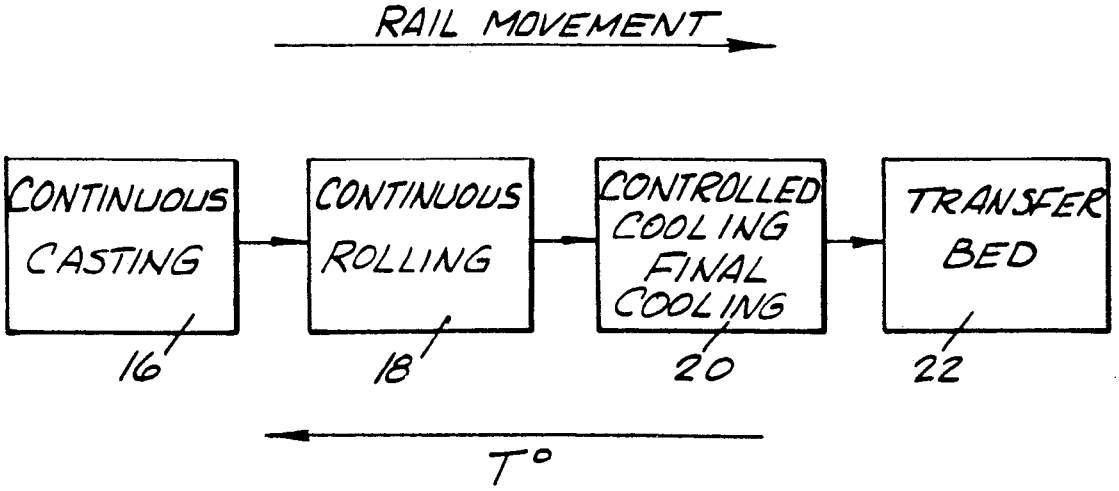
FIG. 2 depicts a schematic representation of the rail manufacturing process of the present invention.

According to the rail manufacturing process of the present invention, molten steel is transformed into rails of superior quality in a generally continuous manner. FIG. 2 depicts a schematic progression of the steel. The figure depicts both the physical direction of the steel, and the relative temperature of the steel as it moves through the basic stages of the process.

The first section of the process is the continuous casting 16 of the malleable steel bloom. The bloom is a rectangular steel form that will, via the continuous rolling process, be transformed into the finished rail. The bloom required to produce a standard rail that is one quarter mile long is about 10"×14"×140' or an equivalent weight in other cross-sections. In a continuous casting process, the molten steel is poured through a mold that has the desired cross-sectional shape, and the molten steel flows through the mold until it is cooled and attains a generally solid form. At this point the steel exits the casting mold. Continuous casting is in contrast to fixed mold casting, wherein a mold is filled with molten steel, allowed to solidify, and the mold removed, leaving an ingot to be reheated and rolled.

The upper portion of the mold of the continuous caster is held in a vertical position, with the molten steel being poured into the top. The steel is allowed to flow through the mold at such a speed that the steel is relatively firm when exiting the bottom of the mold and is directed in a horizontal direction. The continuous movement of the bloom may be continued directly into the continuous rolling section 18. Alternatively, the bloom may be allowed to cool and then reheated prior to entering the continuous rolling section 18.

In one embodiment of the present invention, the continuous casting and continuous rolling processes are maintained in-line so that the continuously cast bloom proceeds directly from the exit of the continuous casting mold into the continuous rolling section. In a preferred embodiment of the invention, there are a plurality of continuous casting molds associated with one continuous rolling section. The casters will each produce blooms that will enter into the continuous rolling station. The plurality of casters is preferred, because the bloom production rate is generally much slower than the velocity of the bloom at the entrance into the continuous rolling section 18.

As described above, in the continuous rolling section 18 the malleable steel bloom is continuously and simultaneously processed and formed as it proceeds through a series of rolling stations. The rolling stations are aligned in a straight line in a fixed position. As the lead end of the bloom moves from station to station, each successive rolling station will act to form and to reduce the cross-section of the incipient rail.

It should be remembered that as the bloom is formed and shaped, the length of the bloom increases from about 140 feet to about 1440 feet. Therefore, the Velocity of the metal as it exits the continuous rolling section 18 is significantly faster than the velocity of the metal entering the continuously rolling section—even when a single rail is at both the exit and entrance.

As the metal exits the continuous rolling section 18, the rail—which is still moving in a straight line in the same direction—enters the controlled cooling section 20 of the process. In the controlled cooling section 20, cooling means (utilizing water, mist or air) are applied to the rail in an asymmetric manner. As the rail exits the continuous rolling section 18, it may be about 1400° F. to 1800° F. The rail exiting the controlled cooling section 20 will be less than about 800° F. Much of the shrinkage of the rail that will occur as the rail cools, will occur in the controlled cooling section 20. The primary function of the controlled cooling section 20 is for the prevention of rail warping and bowing in addition to achieving desireable metallurgical properties. The ability to prevent bowing is extremely critical when dealing with rails that are up to 1440 feet long.

Due to the continuous nature of the process of the present invention, during much of the rail formation process differen' portions of a given rail may be subjected to both rolling and controlled cooling simultaneously.

The continuously moving rail exits the controlled cooling section 20 and proceeds to the final cooling section 22. In the final cooling section, the rail is cooled to normal handling temperatures.

Figure 4:
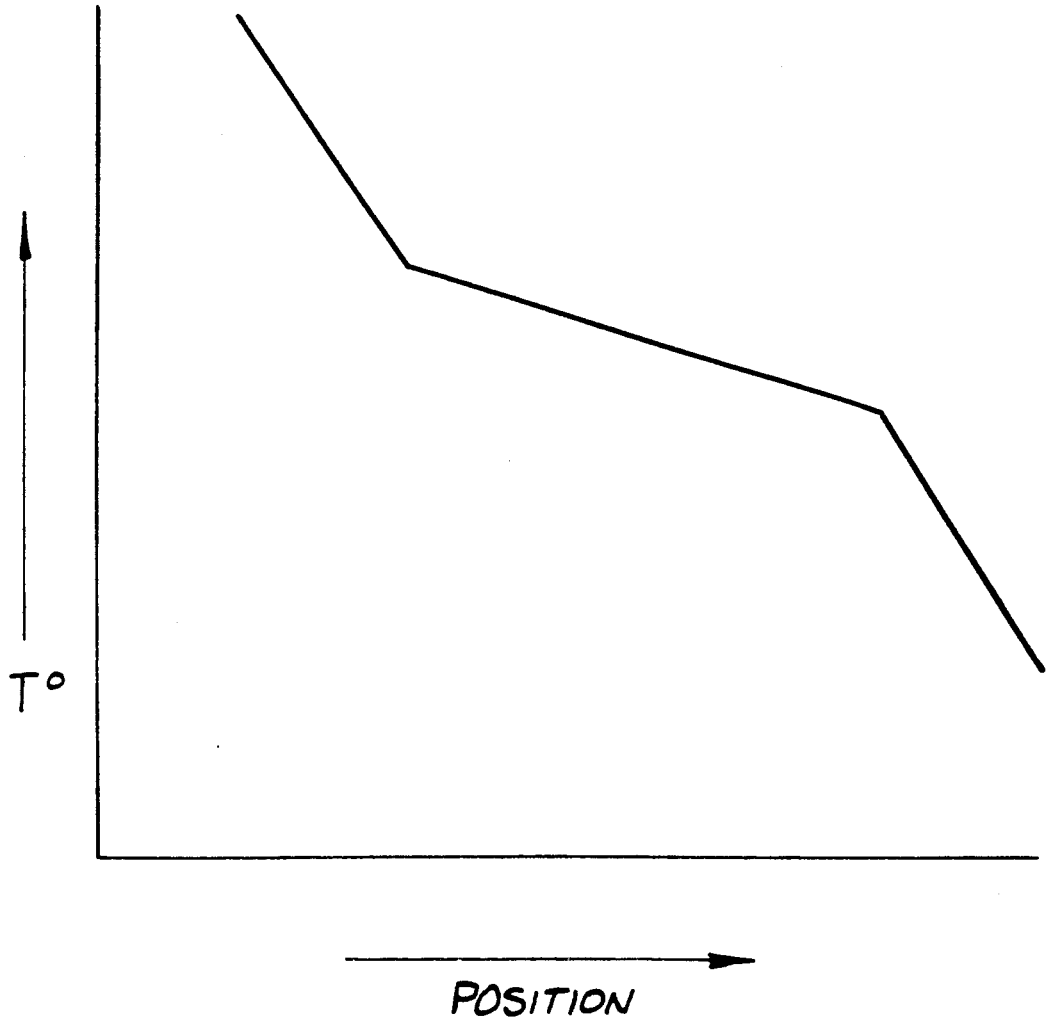
FIG. 4 shows a graphical representation of the temperature of a rail versus its position in the controlled cooling portion.

FIG. 4 shows in a schematic manner the temperature gradient along the length of a rail which is in the controlled and final cooling sections. Because the rail moves at a uniform rate in the controlled and final cooling section, this graph of temperature versus position on the rail would also correspond to temperature versus time with respect to a single moving point on the rail. As the trailing end of the rail exits the final rolling section and enters the controlled cooling section, the temperature is substantially equal to the desired rolling temperature for the final rolling station. That is shown as the left edge of the graph of FIG. 4. The rail can be cooled rapidly from that temperature, because the cooling rate at that temperature does not substantially affect the metallurgical properties of the rail. However, even at that temperature, the rail may tend to bow or otherwise deform due to the asymmetrical cross-section and differential cooling rates, so some controlled cooling by differential application of cooling means may be required.

Moving along the length of the rail, a point is reached where the cooling rate becomes important to the desired metallurgical properties of the rail. That point is shown as the relatively gently inclined cooling line in the middle of FIG. 4. During that portion, the rail is cooled in a manner which achieves two distinct functions. One is to achieve the desired metallurgical properties, and the other is to differentially apply cooling means to the asymmetrical cross-section to avoid bowing or other deformation.

Finally, continuing to move along the length of the rail toward the leading end, a point is reached where the rail temperature is such that the cooling rate is again not important to the desired metallurgical properties. This is the final cooling section, and is represented by the steep cooling rate on the right side of FIG. 4. As in the case of the steep cooling rate as the rail exists the last roller station and enters the controlled cooling section, however, the rail may still require some differential application of cooling means to avoid undue bowing or other deformation.

The use of continuous rolling allows a reduction in the rail velocity as it passes through the rolling stations, and this reduction is important to the controlled cooling process. In a reverse rolling process, the rail is generally passed through the same rolling station several times as that rolling station progressively reduces the rail cross-section. Therefore, a high rail velocity is necessary on each pass in order to maintain a given production rate. In contrast, in a continuous rolling process, the multiple passes of the reverse rolling process are replaced with multiple in-line rolling stations. This allows a dramatic reduction in rail velocity for the same production rate. The reduced rail velocity of continuous rolling is compatible with continuous in-line controlled cooling, while the high velocity of reverse rolling is not. These reduced velocities also facilitate control of the rail and safety.

Once the entire rail has proceeded through both the continuous rolling section 18 and the controlled and final cooling section 20, the forward movement of the continuous process is halted with respect to that rail. The completed rail is then moved laterally in the transfer bed station 22.

The movement of the rail from the continuous casting section 16, to the continuous rolling section 18, to the controlled cooling and final cooling section 20 and finally to the transfer bed section 22 comprise the basic elements of the process of the present invention.

Figure 3:
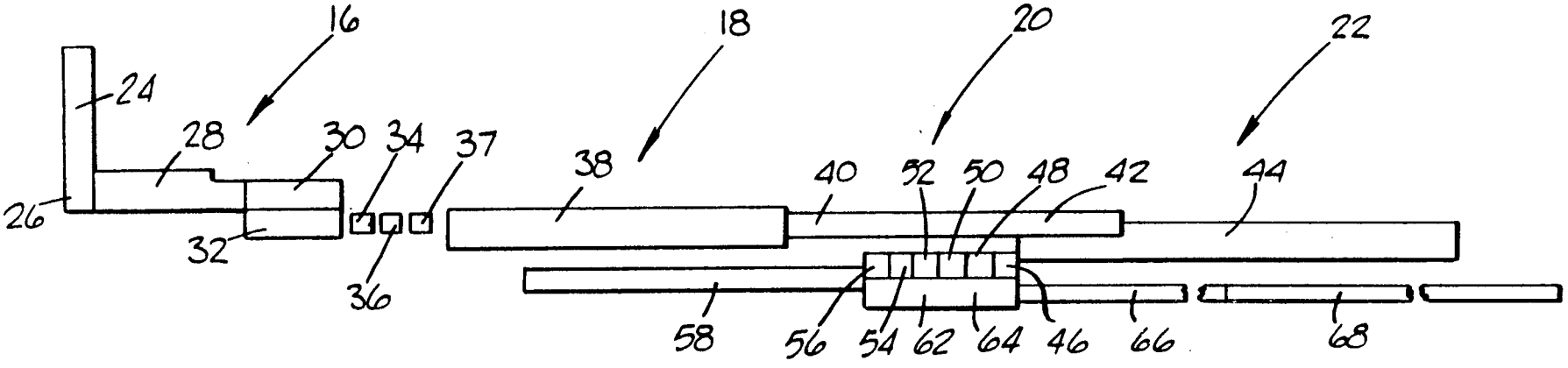
FIG. 3 shows a schematic layout of an embodiment of a manufacturing facility according to the present invention.

A more detailed depiction of a preferred embodiment of the manufacturing system and method of the present invention is depicted in FIG. 3. FIG. 3 shows a schematic overview of a manufacturing facility that may be employed to practice the method of this invention. Each of the specific areas of the facility will be described in the order that the incipient rail travels along its way to becoming a completed rail ready to be loaded onto a train.

The continuous casting section 16 is comprised of a hot metal transfer area 24, a degasser and reheat area 26, a caster apparatus 28, a bloom transfer bed 30, and a bloom holding furnace 32.

The production of the rail must begin with hot, molten steel. The steel may come from raw materials or the melting of scrap metal. In a preferred embodiment, the molten steel is created via the reheating of selected scrap metal in electric arc furnaces, wherein the chemistry, deoxidation, temperature and desulfurization of the molten steel may be carefully controlled. The molten steel is transferred to the top of the caster 28 from the source of molten steel. The molten steel is transferred to the caster in the hot metal transfer area 24.

Prior to introduction into the caster 28, the molten steel is reheated and degassed at area 26. The characteristics of the molten steel are evaluated and any alterations in the chemical composition or temperature necessary prior to casting are made in the reheat and degassing area 26.

The continuous caster 28 consists of one or more continuous casting molds. The molds are vertical in the upper most portions where the molten steel is the most fluid. The molds may curve toward horizontal in order to facilitate the flow of steel out of the mold in a horizontal direction.

The bloom transfer bed 30, is an area for storing and transferring the blooms produced in the caster apparatus 28. The transfer bed 30 is capable of moving the malleable bloom perpendicular to its length. The bloom holding furnace 32 is adjacent the bloom transfer bed 30, and serves two functions. The holding furnace helps assure that the bloom is maintained at a consistent and desireable temperature for rolling. The holding furnace is also equipped with means for transferring the bloom to the entrance of the continuous rolling section 18.

The continuous rolling section 18 is comprised of a crop/shear area 34, an induction heat area 36, a descaler 37 and a rolling mill 38. In the crop/shear area 34, means are provided for preparing the leading edge of the bloom for introduction into the rolling mill. In the induction heat area 36, means are provided for assuring the proper temperature consistency within the bloom as it passes through the area.

The rolling mill 38 is made up of a plurality of rolling stations in line with each other. The rolling stations consist of a motor and large spinning rollers that are designed to exert deformable pressure on the steel passing between the rollers. The rollers also act to move the steel through the rolling mill 38.

The controlled cooling section 20 of the present invention contains a controlled cooling area 40 and final cooling area 42. The controlled cooling section 20 has means for asymmetrically treating the formed rail in order to prevent significant bowing of the rail during the cooling of the rail from its final rolling temperature. The controlled cooling may be performed by the application of a mist or gas stream to selected areas of the rail. The cooling is controlled both to prevent deformation and to achieve desired metallurgical properties.

In the final cooling area 42 a more symmetric cooling of the rail is employed, but differential cooling is still required to achieve acceptable rail straightness. In the rail transfer bed 44, the forward motion of the rail is halted and the rail may be moved laterally.

The areas just described are necessary to continuously form a one quarter mile long unitary rail according to the method of the present invention. However, completion of the rail treatment process involves a number of additional functional steps. In a preferred embodiment of the present invention, the additional areas of the post-formation section include:

rail straightener area 46,
post-rolling descaler area 48,
position sensor 50,
UT inspection 52,
surface inspection 54
paint marking 56
transfer bed 58
saw and drill 62
welder 64
storage rack 66
train loading rack 68

The rail straightener area 46 contains means capable of correcting slight bowing imperfections in the rail product. In one embodiment, the rail straightener consists of massive rollers that will exert from 100 to 180 tons of straightening force on the rail. The exterior surface of rails are descaled in the descaler area 48. The position sensor 50 acts to verify acceptable rail straightness. The rail is ultrasonically inspected at the UT inspection area 52 for internal defects. Ultrasonic inspection will detect internal flaws in the head, web and base portions of the rail. Surface inspection of the rail occurs at the surface inspection area 54. Where required, paint marks are applied to any defective portions of the rail at the paint area 56.

Transfer bed 58 provides means for laterally moving the rail. Saw and drill area 62 has means for sawing rail ends and the rails on either side of any imperfection noted in the inspection processes and for drilling bolt holes if required. It also prepares the two pieces for welding. The welding area 64 has equipment for welding the rail where sections have been cut out in the saw and drill area 62. The storage rack 66 is capable of storing several of the finished rails, and the train loading rack 68 provides means for loading the finished rail onto a railroad car for removal of the rail from the manufacturing site.

In the post-formation processing of the rail, the rail is first moved laterally in the rail transfer bed 44. After transfer, the rail is moved axially in the direction opposite the movement of the rail in the formation process. The leading edge of the rail passes the rail straightener area 46, the descaler area 48, the position sensor 50, the UT inspection area 52, the surface inspection area 54, and the paint area 56. Upon exiting the paint area 56, the leading edge of the rail proceeds onto the transfer bed 58 until the entire rail has passed through the paint area 56 and at which time the axial movement of the rail is stopped. The rail is moved laterally in the transfer bed, and the leading end is sawed off at the saw and drill area 62.

At this time, axial movement of the rail is begun, now in the same direction as the rail during the rail formation process. If any areas of rail imperfections were identified during the inspection processes, as the rail passes through the saw and drill area 62, the forward movement will be halted and the rail will be sawed on either side of the imperfection. The two ends will then be welded together at the weld area 64. The rail motion will then continue until the trailing end of the rail reaches the saw and drill area 62. The trailing end will be sawed off and the rail motion will then continue until the entire rail is placed on the storage rack 66.

Based on the disclosures herein, and information generally known and available, it would be possible for one of ordinary skill in the art to manufacture one quarter mile long rails according to the method of the present invention. The description of a preferred embodiment of the present invention as given above is meant to provide an example and elaboration of the invention, but is not intended to limit the scope of the claims as set forth below.

We claim:

1. A method for manufacturing a railroad rail at least 500 feet long and free of welds, comprising: forming a bloom by continuously casting, reheating said bloom to a temperature that is consistent along its length and maintaining said temperature so that the first rolling station rolls the bloom at a constant temperature along its length, and continuously rolling said bloom in a single direction with a plurality of in-line rolling stations to form said rail.

2. The method of claim 1, wherein said step of continuously rolling the bloom includes differentially cooling the bloom between at least one pair of adjacent rolling stations to obtain a desired rolling temperature.

3. The method of claim 1, further comprising differentially cooling the rail after it exits the last rolling station to control shrinking and bowing.

4. The method of claim 1, wherein said method is to produce a railroad rail approximately one-quarter mile long and free of welds.

5. The method of claim 1, further comprising enhancing the metallurgical properties of said rail by cooling it in a controlled manner after it exits the last rolling station.

6. The method of claim 1, wherein said bloom weighs over 20,000 pounds.

7. The method of claim 6, wherein said bloom weighs over 60,000 pounds.

8. A method of building railroad track, comprising: continuously casting a steel bloom, continuously rolling a steel shape from said bloom to a substantially complete rail that is at least 500 feet long and substantially free of weld seams using a plurality of in-line rolling stations so that the steel shape passes each rolling station no more than once, transporting said at least 500 foot rails to a rail bed, and attaching said at least 500 foot rails end-to-end in two parallel strands to produce a railroad track.

9. The method of claim 7, wherein said at least 500 foot rails are at least 1400 feet long.

* * * * *